United States Patent [19]

Sugiyama

[11] Patent Number: 4,484,737

[45] Date of Patent: Nov. 27, 1984

[54] DEVICE FOR PREVENTING SUBSTRATES FROM JAMMING IN A COPIER

[75] Inventor: Satoshi Sugiyama, Tokyo, Japan

[73] Assignee: Rank Xerox Corporation, Stamford, Conn.

[21] Appl. No.: 153,109

[22] Filed: May 23, 1980

[30] Foreign Application Priority Data

Jun. 28, 1979 [JP] Japan ..... 54-087568[U]

[51] Int. Cl.[3] ..... B65H 3/36; B65H 3/06

[52] U.S. Cl. ..... 271/264; 271/306; 271/210; 193/2 B; 355/3 SH

[58] Field of Search ..... 271/146, 306, 210, 278, 271/8 R, 264, 109; 193/2 B; 226/196; 355/3 SH, 14 SH

[56] References Cited

U.S. PATENT DOCUMENTS

| | | | |
|---|---|---|---|
| 1,432,738 | 10/1922 | Alwart | 193/2 B |
| 3,545,741 | 12/1970 | Porth | 271/146 X |
| 3,941,242 | 3/1976 | Braden | 193/2 B X |
| 4,014,538 | 3/1977 | Akiyama et al. | 271/308 X |

*Primary Examiner*—Bruce H. Stoner, Jr.
*Assistant Examiner*—James E. Barlow
*Attorney, Agent, or Firm*—Bernard A. Chiama

[57] ABSTRACT

A device for preventing a substrate from jamming in a copier includes a guide member that directs a substrate from a substrate supply tray to a photosensitive member. The guide member is adapted to be vibrated by a vibration generator in order to prevent substrates passing through the guide member from jamming.

1 Claim, 2 Drawing Figures

DEVICE FOR PREVENTING SUBSTRATES FROM JAMMING IN A COPIER

This invention relates to a device for preventing a sheet from jamming in a copier, wherein a sheet guide member is caused to vibrate, thereby preventing a sheet from jamming within a sheet passageway.

In most of the prior art copiers, in which sheets are placed on a sheet tray, it has been customary that copy sheets are fed one by one from the sheet tray at every cycle of copying operations, and that a guide member and a transporting roll are used as sheet transporting means. The copier having a transporting roll, however, requires a mechanism for driving the transporting roll, thus resulting in complicated construction, and requires a special space for installing the transporting roll. A suggestion has been advanced that a guide member alone be employed for transporting the sheets. The guide member, however, is deficient in transporting ability since it creates a frictional drag on sheets as they pass over the guide surface and there are no rollers to propel the sheets. Where a curved transporting passage is provided in the copier, sheets tend to jam in the curved portion of the transporting passage, because of the guide member's low transporting ability due to frictional drag and the beam strength of the sheets tending to counter propulsion forces applied to the sheets prior to their entering the curved passage.

Accordingly, the present invention provides a device for preventing a sheet from jamming in a copier, wherein vibration is applied to a guide member disposed along a sheet passage, so as to provide an increased transporting ability for the guide member, so that the likelihood of a sheet jamming in a curved portion of the sheet passage is reduced substantially.

This and other features of the invention will be apparent with reference to the following specification and to the drawings wherein.

Figure 2:
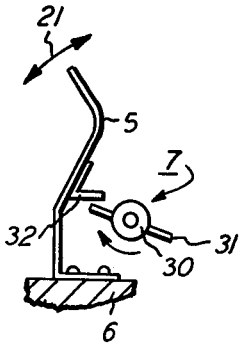
FIG. 2 is a schematic view of a vibration generating means according to another embodiment of the present invention.

The present invention will now be described with reference to the accompanying drawings. Shown at 1 is a cylindrical photosensitive member disposed within the body proper of a copier (not shown), and at 2 a sheet tray disposed below photosensitive member 1 and having thereon a number of sheets 3 stacked in a superimposed fashion. Disposed above sheet tray 2 is a feed roller 4, which is so arranged as to pay out sheets 3 one by one from sheet tray 2 at every cycle of copying operations. Sheet 3 is fed from tray 2 by feed roller 4 and propelled upward along a guide member 5 disposed on the downstream of sheet tray 2, as viewed in a direction of travel of a sheet. Guide member 5 is made of a thin metal plate and has substantially an inverted V-shaped stem and a horizontal foot, at which the guide member is rigidly secured to part of a copier frame 6. A vibration generating means 7 is provided near the base portion of guide member 5. Vibration generating means 7 is, for example, an electromagnet. When alternating current is conventionally supplied from an AC source 8 to a coil 10 near guide member 5, the upper portion of the guide member 5 is caused to vibrate in the direction of arrow 20. As an alternative, vibration generating means 7 may be a rotary member 30 having a pawl 31 as shown in FIG. 2. In the latter case, rotary member 30 is rotated, so that pawl 31 is intermittently brought into engagement with a pawl 32 of guide member 5, whereby the upper end of guide member 5 is caused to vibrate in the direction of arrow 21.

Figure 1:
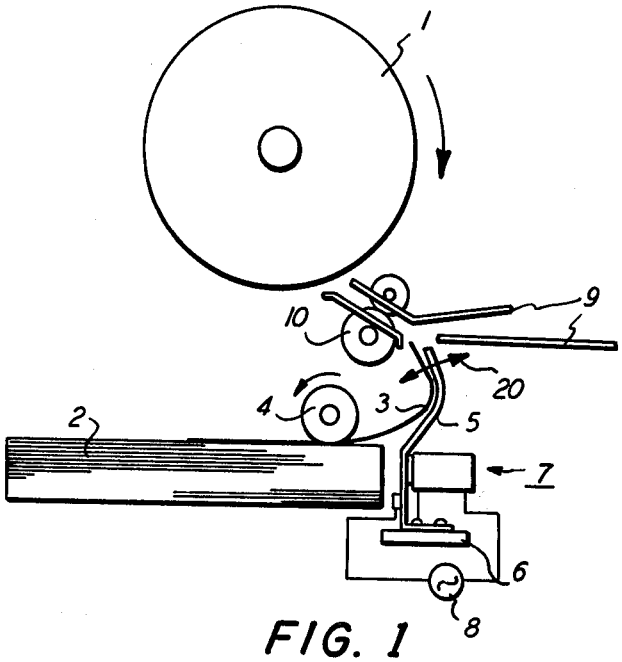
FIG. 1 is a schematic view of a device according to a preferred embodiment of the present invention.

A guide plate 9 and registration roller means 10 are provided in FIG. 1 between the upper portion of guide member 5 and photosensitive member 1, with the guide plate being arranged to guide a sheet toward the photosensitive member 1, and the registration roller means making a sheet-feed time synchronous with rotation of photosensitive member 1.

In conclusion, and in accordance with one aspect of the present invention, vibration is applied by vibration generating means 7 to guide member 5 for guiding sheet 3 from sheet tray toward photosensitive member 1 without jamming of the sheet occurring. Sheets can be forwarded through even a curved guide member and transported smoothly to photosensitive member 1 with the transporting ability of the guide member by the activation of vibration means 7 being increased, thus preventing a sheet from jamming in the sheet passage during transportation of the sheet. According to the present invention, vibration generating means 7 is added in the vicinity of guide member 5, with space saving as a result and thereby creating a less costly device, without a need for a large scale drive means.

In addition to the apparatus outlined above, many modifications and/or additions to this invention will be readily apparent to those skilled in the art upon reading this disclosure and these are intended to be encompassed within the invention disclosed and claimed herein.

What is claimed is:

1. In a reproduction machine having a photoreceptor for producing copies of an original upon copy sheets including a sheet tray for holding a stack of sheet preparatory to receiving images thereon, said tray being positioned below the photoreceptor, sheet feed means positioned adjacent said sheet tray and arranged for feeding sheets therefrom in seriatim, guide means positioned to receive sheets from said sheet tray and to direct the sheets upwardly toward the photoreceptor, and vibration means operatively associated with said guide means and being operable to vibrate the same as sheets are being directed thereby.

* * * * *

UNITED STATES PATENT AND TRADEMARK OFFICE

CERTIFICATE OF CORRECTION

PATENT NO. : 4,484,737

DATED : November 27, 1984

INVENTOR(S) : Satoshi Sugiyama

It is certified that error appears in the above-identified patent and that said Letters Patent are hereby corrected as shown below:

Title page, Item [73]:

After "Assignee:", delete "Rank Xerox Corporation, Stamford, Conn." and insert in place thereof --Rank Xerox Limited, Great Britain--

Signed and Sealed this

*Fourteenth* Day of *May 1985*

[SEAL]

*Attest:*

DONALD J. QUIGG

*Attesting Officer* *Acting Commissioner of Patents and Trademarks*